United States Patent [19]

Ehmann et al.

[11] Patent Number: 4,768,724

[45] Date of Patent: Sep. 6, 1988

[54] BREAKER PLATE FOR ROCK CRUSHER

[75] Inventors: Guy A. Ehmann, P.O. Box 141, Burlington, Ontario, L7R 3X8; Arthur W. Cooper, Ancaster, both of Canada

[73] Assignee: Guy Ehmann, Burlington, Canada

[21] Appl. No.: 843,734

[22] Filed: Mar. 25, 1986

[51] Int. Cl.[4] ..... B02C 19/00

[52] U.S. Cl. ..... 241/275; 241/300

[58] Field of Search ..... 241/275, 300, 5, DIG. 30, 241/182, 183, 299

[56] References Cited

U.S. PATENT DOCUMENTS

| | | | |
|---|---|---|---|
| 2,991,949 | 7/1961 | Sellars | 241/275 |
| 3,067,013 | 12/1962 | Lamb | 241/275 X |
| 3,148,840 | 9/1964 | Behnke | 241/275 |

*Primary Examiner*—Mark Rosenbaum

*Attorney, Agent, or Firm*—Philip Furgang

[57] ABSTRACT

A vertical shaft rock crusher has a frame attached to its outer shell to which a support ring is horizontally mounted. A plurality of breaker plates are disposed on the support ring in an interlocked arrangement. The breaker plates are disposed in a staggered array to form rings of breaker plates stacked in a brick-like manner and require no mounting hardware. One breaker plate embodiment has a relatively smooth circumferentional surface, another have V-shaped grooves disposed in the rock crushing surface. A third embodiment has pockets formed between the stacked rings. Interconnection of adjacent breaker plates, in one embodiment of interconnection structure is accomplished by forming a slot on one side of the breaker plate and a mating post on the other side, such that adjacent plates may be interlocked to each other.

12 Claims, 5 Drawing Sheets

BREAKER PLATE FOR ROCK CRUSHER

BACKGROUND OF THE INVENTION—FIELD OF APPLICATION

This invention relates to rock crushers; and more particularly to breaker plates for rock crushers.

BACKGROUND OF THE INVENTION—DESCRIPTION OF PRIOR ART

In 1830 the first U.S. patent was issued for a rock crushing machine. Since that time many patents on various machines for crushing rock have been granted. In the period between 1860 and 1878 several basic designs were developed using the gyratory principle. In 1881, P. W. Gates was granted a patent which encorporated all of the explicite details of the modern gyratory crusher.

Developments in the mining industry required finer crushing than was feasable with the gyratory or jaw crushers available at that time. These machines do a great portion of their work by impact. In the Edison roll crusher impact is supplemented significantly by a power sledging action by teeth attached to the large rolls. The predominate action in the hammermill is impact.

Impact type crushers are currently used employing vertical shaft rock crushing machines which have impellers which propel the rock into breaker plates causing high force impact against the breaker plates where the rock is broken.

A number of rock crushers employing vertical shaft design have replaceable and/or adjustable breaker plates. The methods of attachment include pins, tee shots, wedge pins, hooks, bolts, notches, and keways. These methods are variously shown in; U.S. Pat. No. 3,088,685 issued to T. E. Bridgewater on May 7, 1963 and in two other U.S. Pat. Nos. 3,093,329 and 3,110,449 issued to T. E. Bridgewater on June 11, 1963 and Nov. 12, 1963 respectively. Other patents which show various ones of the attachment methods described above include: U.S. Pat. No. 3,150,838 issued to C. A. Adams on Sept. 9, 1964; U.S. Pat. No. 3,540,667 issued to C. T. Parker on Nov. 17, 1970; U.S. Pat. No. 4,090,673 issued to S. B. Ackers et. al. on May 23, 1978; U.S. Pat. No. 4,326,676 issued on Apr. 27, 1982 to N. M. Rose; U.S. Pat. No. 4,347,988 issued to K. D. Warren et. al. on Sept. 7, 1982 and U.S. Pat. No. 4,389,022 issued on June 21, 1983 to J. H. Burk. U.S. Pat. No. 3,168,991 issued to D. E. Herman on Feb. 9, 1965 shows breaker plates with V-shaped pockets and which are secured to the wall of the crusher. Other V-shaped breaker plates are shown in U.S. Pat. No. 3,474,974 issued to Wood Oct. 28, 1969; U.S. Pat. Nos. 3,873,047 and 4,065,063 issued Mar. 25, 1975 and Dec. 27, 1977 respectively to L. W. Johnson; but as in the patents previously discussed attachment of the breaker plates is by bolts, cleats, and brackets of various design.

When rocks are crushed by propelling rocks against breaker plates the breaker plates wear at a high rate due to the abrasive action of the rock. Frequent replacement of breaker plates is an inherent aspect of this type of rock crusher. Breaker plates of the type hereinabove discussed require mechanical dis-assembly and reassembly for replacement.

SUMMARY OF THE INVENTION

It is therefore an object of this invention to provide a new and improved breaker plate.

It is another object of this invention to provide a new and improved rock crusher breaker plate.

It is another object of this invention to provide a new and improved rock crusher.

It is still another object of this invention to provide a new and improved breaker plate for disposition in a brick-like arrangement.

It is yet another object of this invention to provide new and improved breaker plates of truncated pyramidal shapes.

It is a further object of this invention to provide new and improved breaker plates which interlock one with the other.

It is still a further object of this invention to provide new and improved breaker plates which form a V-shaped pocket within the rock crusher.

Other objects, features and advantages of the invention in its details of construction and arrangement of parts will be seen from the above, from the following description of the preferred embodiment when considered with the drawing and from the appended claims.

DESCRIPTION OF THE PREFERRED EMBODIMENT

Figure 1:
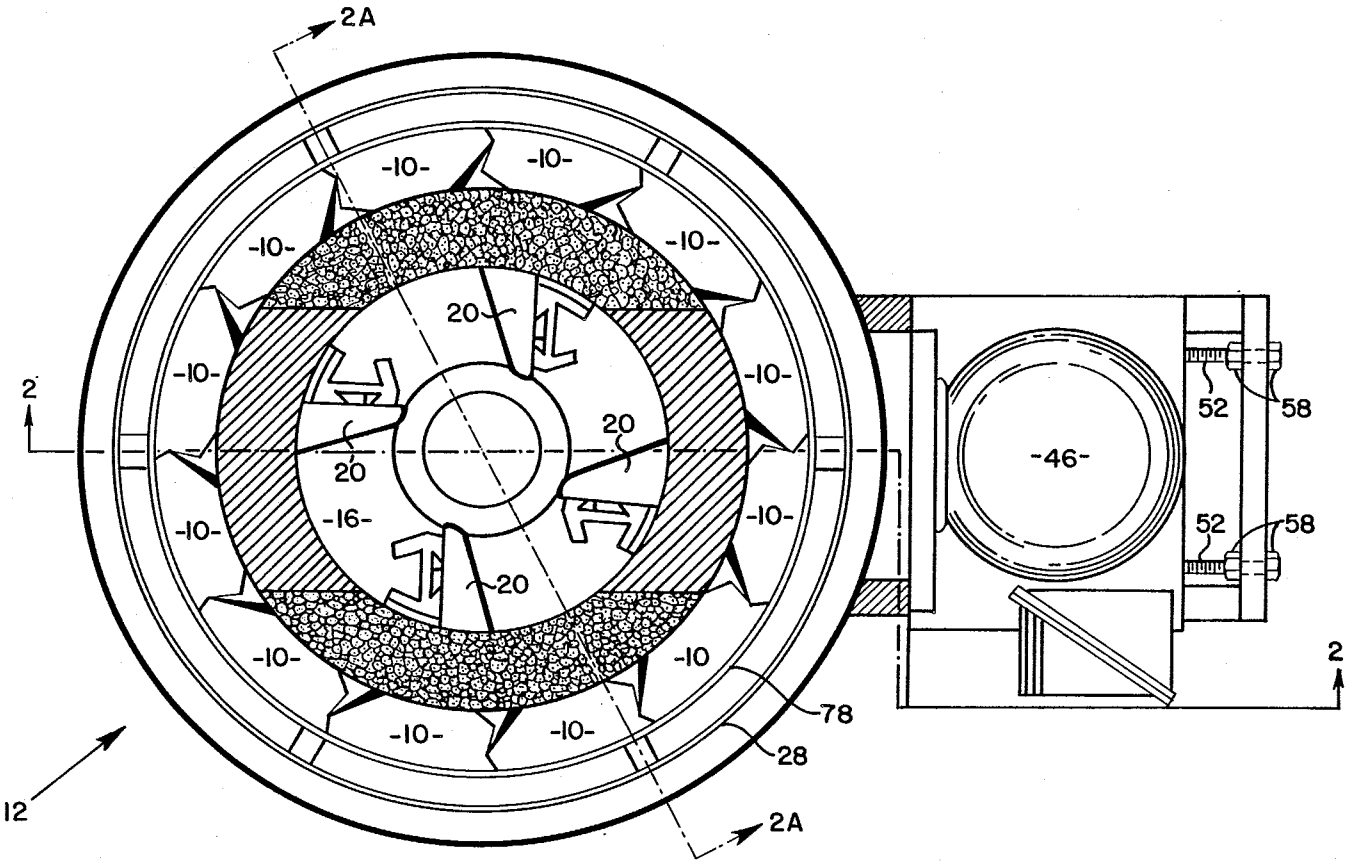
FIG. 1 is a plane view of the rock crusher incorporating the instant invention.
Figure 2:
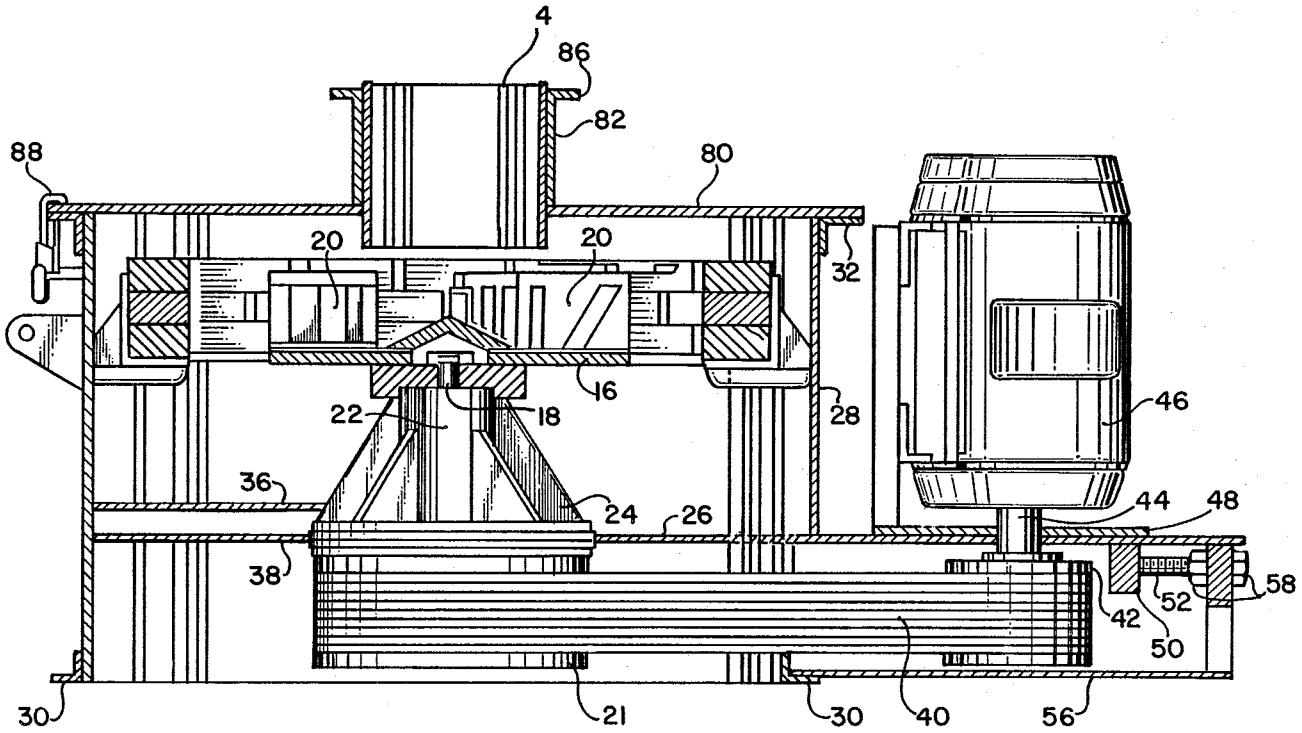
FIG. 2 is a side view of the rock crusher taken through line 2—2 of FIG. 1.
Figure 2A:
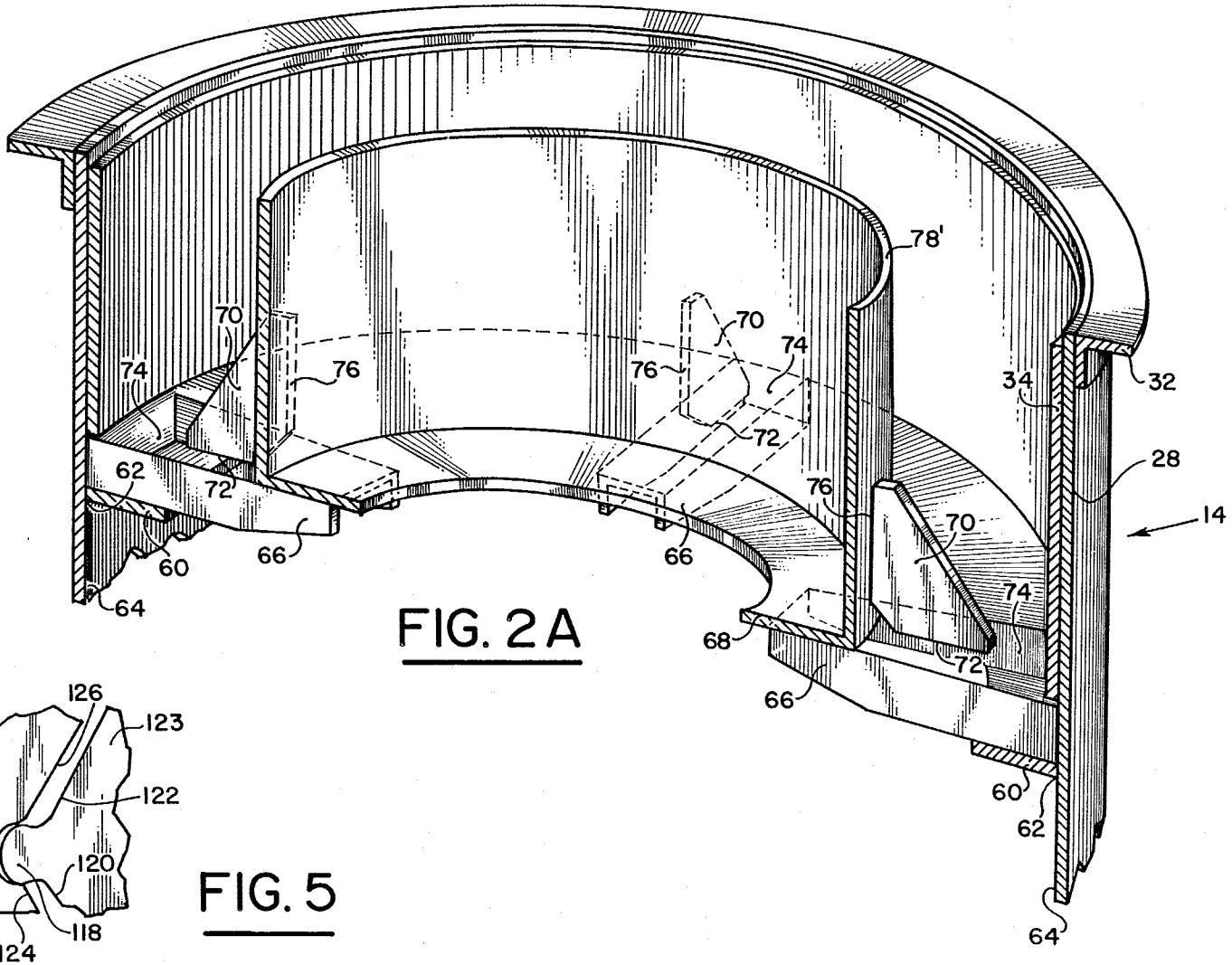
FIG. 2A is a perspective view taken of a portion of the crusher of FIGS. 1 and 2 with the impeller plate, breaker plate and drive removed.

With reference to FIG. 1 there is generally shown a plurality of breaker plates 10 arranged for use in a rock crusher 12. Rock crusher 12 consists of a frame 14 (FIG. 2A) and an impeller mounting plate 16 rotationaly driven by a vertical shaft 18 (FIG. 2) in a conventional manner.

Fixedly attached to plate 16 are a plurality of impellers 20 of conventional design. Shaft 18 is pinned, keyed or otherwise conventionally attached to a shieve 21 and runs in a bearing 22 which is mounted in a housing 24 fixedly attached to a first support plate 26.

Frame 14 (FIG. 2A) has an outer shell 28 essentially cylindrical in form which is secured to a base flange 30. Shell 28 is the primary structural member of rock crusher 12, and is constructed of steel plate or the like, roll formed by a conventional process. Fixedly attached by welding, bolting or the like to shell 28 is an upper flange 32 and a ring 34 (FIG. 2A) both of which strengthen shell 28. Flange 32 and ring 34 are fixedly attached to shell 28 by welding, bolting or the like, and are of materials similar to that used for wall 28. Support plate 26 extends through shell 28 and is fixedly attached thereto. A second support plate 36 and a third support plate 38 are disposed diametrially opposed to plate 26 and are attached to housing 24 and shell 28 by suitable and conventional means. A series of V-belts 40 are disposed around shieve 21 and a drive shieve 42 pinned, keyed or otherwise conventionally attached to a motor output shaft 44. A motor 46 is vertically mounted to an adjusting plate 48 which is disposed on plate 26. Plate 26 is slotted to accept a pair of adjusting blocks 50 attached to plate 48 by welding, bolting or the like. Blocks 50 act within pair of adjusting screws 52 which are mounted in a vertical member 54 which is fixedly attached to plate 26 and a bottom plate 56. Plate 56 is fixedly attached to wall 28. Adjusting screws 52 are secured by two sets of nuts 58 once proper tension is obtained on belts 40.

A support plate 60 is disposed perpendicular to shell 28 and is fixedly attached by welding, bolting or the like at an outer surface 62 to shell 28. The diameter of surface 62 being of predetermined size to slip fit within the diameter formed by an inner surface 64 of shell 28. Support plate 60 extends radially inward from surface 64 a predetermined distance sufficient to support a plurality of brackets 66 spaced equidistant one to the other around inner surface 64 of shell 28 and extending radially inward a predetermined distance such that a breaker plate support plate 68 is fixedly attached thereto. The radial inward extent of bracket 66 and support plate 68 are sufficient to hold breaker plates 10 when disposed on support plate 68. Additionally a guset 70 is disposed essentially central to each bracket 66. A first side 72 of guset 70 is fixedly attached to a top surface 74 of bracket 66 with a second side 76 fixedly attached to an inner ring 78. Ring 78 is concentric to shell 28 and of a predetermined diameter to accommodate a plurality of breaker plates 101 disposed on support plate 68 to form a continuous ring of interlocked breaker plates 10. Ring 78 is of height to accomodate a predetermined number of layers of breaker plates 10 stacked one upon the other.

A cover 80 of circular configuration is disposed on flange 32 and shell 28 and has a tubular member 82 essentially perpendicular to the plane formed by cover 80 and disposed central thereto. A feed tube 84 is positioned internal to tubular member 82 and extends above a flange portion 86 thereof and below cover 80. Tubular member 82 is an abrasion resistant casting or the like through which rock is fed into crusher 12. Cover 80 is secured to flange 32 by a plurality of clamps 88 which are of the conventional quick release type.

Figure 3:
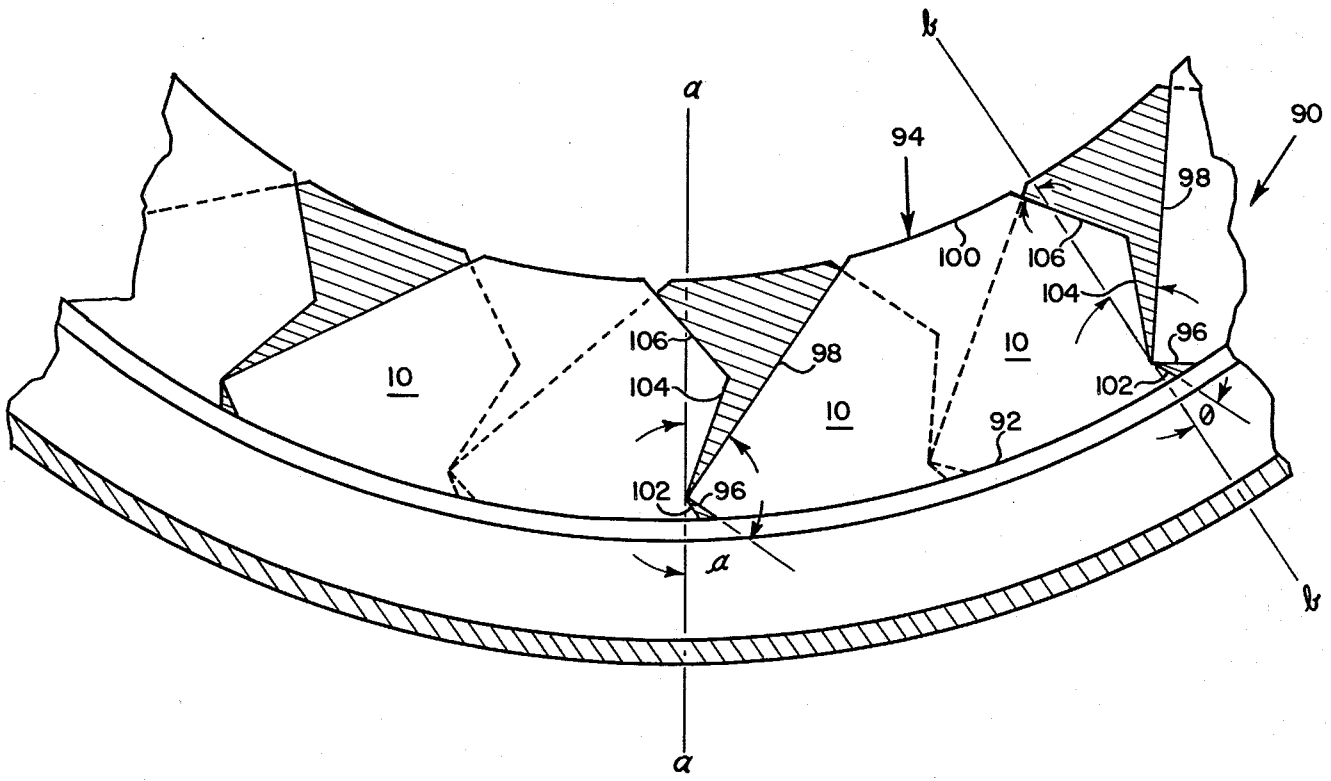
FIG. 3 is a plane view of a portion of the rock crusher incorporating a first configuration of breaker plates.

FIG. 3 shows a preferred arrangement of breaker plates 10. Each plate 10 is essentially a segment of a circular ring 90 consisting of a plurality of plates 10 interlocked one within the other having an outer circumferential surface 92 which forms the other circumference of ring 90 which fits within an inner circumference 94 of ring 78 when disposed as indicated and having a predetermined thickness. A first side 96 of plate 10 extends inwards at an angle "a" taken with respect to line-a—a which is a first limit of the circular segment formed by breaker plate 10. A second side 98 of plate 10 extends inward at an angle "b" taken with respect to line-a—a to an intersection with an inner surface 100 which is a segment of an inside circumference of ring 90. A third side 102 of plate 10 extends inward in the same general direction as side 96 at an angle "0" taken with respect to line b—b which is a second limit of the circular segment formed by breaker plate 10. A fourth side 104 of plate 10 extends inward in the same general direction as side 98 at an angle "w" taken with respect to line b—b. A side 106 of plate 10 extends inward at an angle "T", the same general direction as sides 96 and 102. Breaker plate 10 may be constructed from Ni-Hard or similar abrasive resistance material.

Figure 4:
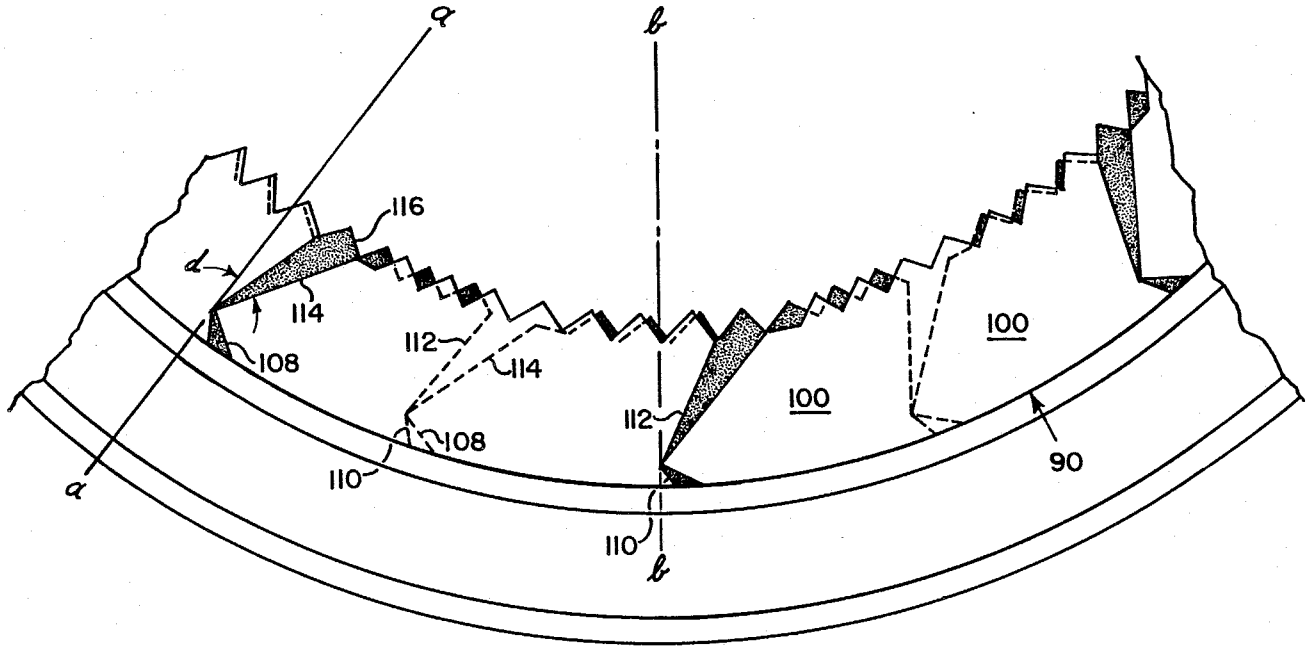
FIG. 4 is a plane view of a portion of the rock crusher incorporating an alternative configuration of breaker plates.

A breaker plate 100 of alternative configuration is shown in FIG. 4 wherein there is shown a similar circular ring 90 consisting of a plurality of plates 100 interlocked one within the other and having an outer circumferences surface 92. Each plate 110 includes side 108, a side 110, a side 112 and a side 114 which are similar to sides 96, 102, 104, and 98 respectively of plates 10. A side 114 extends inward in the same general direction as side 112 at an angle taken with respect to line a—a. Sides 112 and 114 both interect with an inner surface 116 of plates 110 which is shown with a plurality of V-shaped cuts formed horizontally in surface 116. Another configuration of surface 116 would be one which is a continuous arc between sides 114 and 112.

Figure 5:
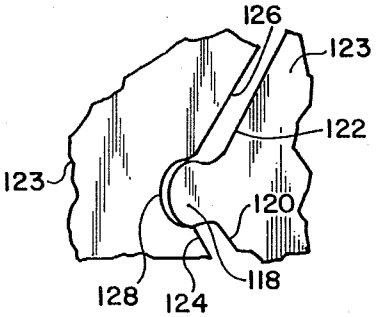
FIG. 5 is a plane view of an alternative interlocking configuration for the breaker plates.

In FIG. 5 there is shown an alternative construction for interlocking plates 10, or 100 together and having a post 118 disposed between a side 120 and a side 122 of adjacent plates 123 and with sides 120 and 122 parallel to a side 124 and a side 126 respectively of adjacent plate 123. A slot 128 is disposed between sides 124 and 126. Post 118 and slot 128 extend the full thickness of plate 123.

It should be noted that when plates 10,100 or 123 are arranged in multiple rows the spaces between the plates of one row are displaced with respect to the spaces of the next adjacent row underneath and the next adjacent row on top.

From the above description it will thus be seen that there has been provided a simple but effective configuration of breaker plates for rock crushers and an efficient manner of arranging the breaker plates within the rock crusher.

What is claimed is:

1. A rock crusher comprising:

(a) an outer shell essentially cylindrical in form;

(b) a drive motor;

(c) a vertical drive shaft mounted generally central to said shell;

(d) an impeller plate fixedly mounted to said vertical drive shaft proximate a top end thereof;

(e) a plurality of impellers disposed on said impeller plate equidistant one to the other and fixedly attached thereto;

(f) a frame having a substantially cylindrical vertically disposed wall essentially concentric to said shell; and (g) a plurality of breaker plates of predetermined shape and thickness disposed on said frame to form multiple rings, each ring consisting of a predetermined number of said breaker plates interlocked one within the other and staggered with respect to each other in adjacent rings;

(h) said breaker plates being multi-sided, each having an outer diametral surface of predetermined size to fit within said wall, an inner circumferential surface concentric to said outer surface, a first side and a second side which form an external V-shaped surface connecting one end of said outer surface and said inner surfaces; third, fourth, and fifth sides; a V-notch formed between between said third and fourth sides; said first side, said third, and said fifth side being disposed in the same general direction as said second side and said fourth side, with said third side, fourth side, and fifth side connecting a second end of said inner and outer surfaces; said adjacent plates defining with said adjacent rings a pocket.

2. The rock crusher of claim 1 wherein said breaker plates are eight sided having an outer circumferential surface of predetermined size to fit within said wall, an inner diametral surface concentric to said outer surface, a first side and a second side which form an external V-shaped surface connecting one end of said outer and inner surfaces, a third side and a fourth side which forms a V-notch, said side first and said third side being disposed in the same general direction as said second side and said fourth side, a second end of said inner surfaces and said outer surface being connected by said third side and said fourth side.

3. The rock crusher of claim 2 wherein a post is disposed proximate the intersection of said first side and said second side a slot disposed proximate the intersection of said third side and said fourth side, said post and said slot traversing the thickness of said breaker plate, said post being of a predetermined size so as to interlock with said slot in an adjacent breaker plate.

4. The rock crusher of claim 2 wherein said inner surface has a plurality of V-shaped protrusions disposed thereon said protrusions extending the thickness of said inner surface and being essentially parallel to said outer surface.

5. The rock crusher of claim 4 wherein a post is disposed proximate the intersection of said first side and said second side slot disposed proximate the intersection of said third side and said fourth side, said post and said slot traversing the thickness of said breaker plate, said post being of a predetermined size so as to interlock with said slot in an adjacent breaker plate.

6. The rock crusher of claim 1 wherein a post is disposed proximate the intersection of said first side and said second side, a slot disposed proximate the intersection of said third side and said fourth side, said post and said slot traversing the thickness of said breaker plate, said post being of a predetermined size so as to interlock with said slot in an adjacent breaker plate.

7. A breaker plate for being disposed as one of a series of adjacent breaker plates, said breaker plate comprising: an outer diametral surface of predetermined size; an inner circumferential surface concentric to said outer surface; a first side and a second side which form an external V-shaped surface connecting one end of said outer surface and said inner surface; third, fourth, and fifth sides; a V-notch formed between said third and fourth sides; and said first side, said third side, and said fifth side being disposed in the same general direction as said second side and said fourth side, with said third side, fourth side, and fifth side connecting a second end of said inner and outer surfaces adjacent and abutting breaker plates defining there between a pocket.

8. The breaker plate of claim 7 wherein the breaker plate is eight sided and has an outer circumfrential surface of predetermined size, an inner diametral surface concentric to said outer surface, a first side and a second side which form an external V-shaped surface connecting one end of said outer and inner surfaces, a third side and a fourth side which forms a V-notch, said side first and said third side being disposed in the same general direction as said second side and said fourth side, a second end of said inner surfaces and said outer surface being connected by said third side and said fourth side.

9. The breaker plate of claim 8 wherein a post is disposed proximate the intersection of said first side and said second side a slot disposed proximate the intersection of said third side and said fourth side, said post and said slot traversing the thickness of said breaker plate, said post being of a predetermined size so as to interlock with the slot of an adjacent breaker plate.

10. The breaker plate of claim 7 wherein said inner surface has a plurality of V-shaped protrusions disposed thereon said protrusions extending the thickness of said inner surface and being essentially parallel to said outer surface.

11. The breaker plate of claim 10 wherein a post is disposed proximate the intersection of said first side and said second side slot disposed proximate the intersection of said third side and said fourth side, said post and said slot traversing the thickness of said breaker plate, said post being of a predetermined size so as to interlock with the slot of an adjacent breaker plate.

12. The breaker plate of claim 7 wherein a post is disposed proximate the intersection of said first side and said second side, a slot disposed proximate the intersection of said third side and said fourth side, said post and said slot traversing the thickness of said breaker plate, said post being of a predetermined size so as to interlock with the slot of an adjacent breaker plate.

* * * * *